US007100487B2

(12) United States Patent
Strand

(10) Patent No.: US 7,100,487 B2
(45) Date of Patent: Sep. 5, 2006

(54) PUNCH DEVICE FOR CREATING A GUIDE NOTCH IN A POLYMERIC FASTENER ATTACHED TO A PLASTIC PACKAGE

(75) Inventor: Aaron L. Strand, Plymouth, WI (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 10/002,811

(22) Filed: Nov. 2, 2001

(65) Prior Publication Data

US 2003/0084763 A1 May 8, 2003

(51) Int. Cl.
*B26F 1/12* (2006.01)

(52) U.S. Cl. ..... 83/553; 83/692; 83/917; 83/921; 29/410

(58) Field of Classification Search ..... 83/921, 83/917, 669, 670, 684, 686, 692, 693, 442, 83/444, 446, 553, 563, 565, 613, 619, 821; 29/408, 409, 410; 383/63, 64, 65, 68, 69; 53/139.2, 412, 133.4; 493/213, 214; 24/399, 24/400, 381

See application file for complete search history.

(56) References Cited

U.S. PATENT DOCUMENTS

| | | | | |
|---|---|---|---|---|
| 2,783,842 | A * | 3/1957 | Mainardi et al. | 83/917 |
| 3,416,986 | A | 12/1968 | Carley | 156/244 |
| 3,948,705 | A | 4/1976 | Ausnit | 156/73.4 |
| 4,240,241 | A | 12/1980 | Sanborn, Jr. | 53/412 |
| 4,246,288 | A | 1/1981 | Sanborn, Jr. | 426/122 |
| 4,265,014 | A * | 5/1981 | Yoshieda et al. | 29/408 |
| 4,437,293 | A | 3/1984 | Sanborn, Jr. | 53/412 |
| 4,982,637 | A | 1/1991 | Osborn | 83/346 |
| 5,088,971 | A | 2/1992 | Herrington | 493/203 |
| 5,405,478 | A | 4/1995 | Richardson et al. | 156/308.4 |
| 5,417,134 | A * | 5/1995 | Fitz, Jr. | 83/446 |
| 5,425,825 | A | 6/1995 | Rasko et al. | 156/66 |
| 5,431,760 | A | 7/1995 | Donovan | 156/66 |
| 5,435,864 | A | 7/1995 | Machacek et al. | 156/66 |
| 5,482,375 | A | 1/1996 | Richardson et al. | 383/64 |
| 5,490,326 | A * | 2/1996 | Nielson | 83/917 |
| 5,598,737 | A * | 2/1997 | Oide | 83/917 |
| 5,617,770 | A * | 4/1997 | May | 29/410 |
| 5,833,791 | A | 11/1998 | Bryniarski et al. | 156/244.25 |
| 6,178,722 | B1 | 1/2001 | McMahon | 53/412 |
| 6,286,189 | B1 | 9/2001 | Provan et al. | 24/30.5 R |
| 6,289,561 | B1 | 9/2001 | Provan et al. | 24/415 |
| 6,292,986 | B1 | 9/2001 | Provan et al. | 24/415 |
| 6,327,754 | B1 | 12/2001 | Belmont et al. | 24/400 |
| 6,347,437 | B1 | 2/2002 | Provan et al. | 24/400 |
| 6,360,513 | B1 | 3/2002 | Strand et al. | 53/412 |
| 6,427,421 | B1 | 8/2002 | Belmont et al. | 53/412 |
| 6,526,726 | B1 * | 3/2003 | Strand et al. | 53/412 |

FOREIGN PATENT DOCUMENTS

| | | |
|---|---|---|
| AU | 252799 | 7/1964 |
| WO | WO 95/29604 | 11/1995 |
| WO | WO 02/12064 A1 | 2/2002 |
| WO | WO 02/13649 A1 | 2/2002 |

* cited by examiner

*Primary Examiner*—Stephen Choi
(74) *Attorney, Agent, or Firm*—Baker Botts L.L.P.

(57) ABSTRACT

A method and apparatus for punching a guide notch in a polymeric zipper having a male and female track with respective fins. The method includes sliding the zipper into position in a punch housing and punching a guide notch into the zipper. The guide notch is defined by a plurality of edges in the zipper, which are guided out of the punch housing.

21 Claims, 5 Drawing Sheets

PUNCH DEVICE FOR CREATING A GUIDE NOTCH IN A POLYMERIC FASTENER ATTACHED TO A PLASTIC PACKAGE

BACKGROUND OF THE INVENTION

A reclosable polymeric bag typically includes first and second opposing panels fixedly connected to each other along a pair of sides and a bottom bridging the pair of sides. The first and second panels are not fixedly connected along a mouth, which is formed opposite to the sealed bottom. Rather, the bag is provided with a reclosable zipper extending along the mouth of the polymeric bag. The zipper includes a male track and a female track. In reclosable polymeric bags of the type utilizing a slider to open the zipper, the male track typically includes a male profile and the female track includes a female profile. The zipper also includes first and second fins extending downwardly from the male and female tracks, respectively. The first and second fins are thermally fused to the inner surfaces of the respective first and second panels.

The male and female tracks are typically free of any plastic material above the male and female profiles in order to permit proper mounting and movement of the slider. The male and female profiles are releasably engageable to each other. When the slider is in a closed position, the male and female profiles are interlocked with each other. In response to moving the slider to an open position, the male and female profiles are disengaged from each other. Once the male and female profiles are disengaged from each other, access to the interior of the bag may be obtained by pulling the first and second panels apart at the mouth.

Opposite ends of the zipper are typically provided with end terminations. The end terminations may perform numerous functions, such as (a) preventing or inhibiting the slider from going past the ends of the fastener, (b) interacting with the slider to give a tactile indication of being closed, (c) assisting in inhibiting or preventing leakage from the bag, and (d) holding the fastener together and providing additional strength in resisting stresses to the bag.

End terminations may be in the form of a strap/clip that wraps over the top of the zipper. One end of the strap is provided with a rivet-like member that penetrates through the zipper fins and into a cooperating opening at the other end of the strap.

In the process of manufacturing the zippers, a long polymeric strip is fed through a manufacturing line. At different points along the manufacturing line, the strip is fitted with end terminations, sliders, and guide notches. The guide notches are cut into the zipper at the points where the strip will be cut to form individual bags. The guide notch is created by a punch mechanism that punches a hole in the male and female tracks and their respective fins. The guide notch is generally a U-shaped hole that starts at the male and female tracks and extends down into the respective fins.

The punch mechanism includes a punch housing and a punch. The housing forms a punch area, an input slot, and an exit slot. During the manufacturing process, the strip slides into the input slot, through the punch area, and out of the exit slot. At predetermined times, the strip stops, and the punch extends into the punch area, cutting the strip to form the guide notch. The guide notch is cut through the male and female tracks and extends down into the respective fins. The guide notch is generally U-shaped and includes a first edge of the male and female tracks and extends downwardly into the fins, a second edge that is generally perpendicular to the first edge, and a third edge that is generally opposite the first edge. After the guide notch has been formed, the punch retracts to its original position and the strip slides through to the next position to be cut.

As the strip advances through the punch housing, however, the second edge of the male and female tracks may not be in perfect alignment with the exit slot and, therefore, may catch on the slot. This slows, or may even stop, the advancement of the strip through the machine and can greatly affect the processing time. Also, if the lack of advancement is not caught immediately, it may cause the punch to form guide notches in incorrect spots along the strip, ruining the strip.

Therefore, there is a need for a punch mechanism that is able to cleanly punch a guide notch into the strip and also provide a timely and precise exiting of the strip from the punch area.

SUMMARY OF THE INVENTION

A method for punching a guide notch in a polymeric zipper having a male and female track with respective fins includes sliding the zipper into position in a punch housing. A guide notch is punched into the zipper such that the guide notch is defined by a plurality of edges in the zipper. The plurality of edges of the zipper are guided out of the punch housing.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
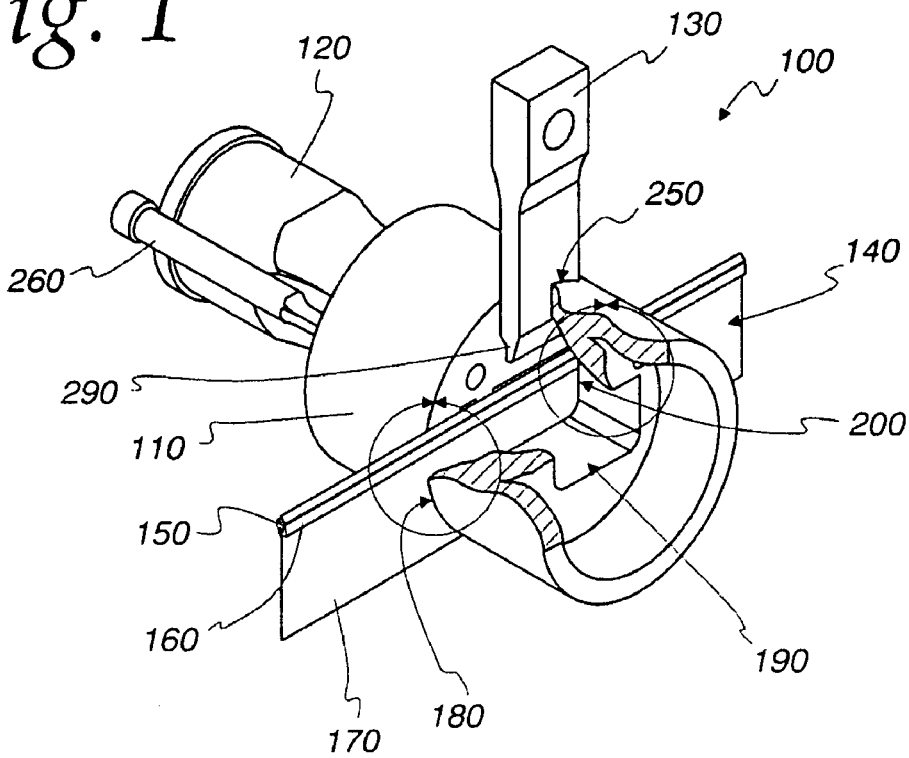
FIG. 1 is a partially cutaway perspective view of a punch mechanism according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to FIG. 1, a punch mechanism 100 includes a punch housing 110, a punch 120, and a guide 130. A strip of a polymer zipper 140 is shown within the housing 110. The zipper 140 includes male and female tracks 150, 160, respectively, which are in engagement with each other. Extending from the male and female tracks 150, 160, are respective fins 170, only one of which is shown.

The male and female tracks 150, 160 and the respective fins 170 are advanced into a first slot 180 through an open region or a punch area 190 and then out of the housing 110 through a second slot 200. The second slot 200 is formed on an opposite side of the punch area 190 than the first slot 180. The first and second slots 180, 200 have the general shape of the zipper 140.

Figure 1A:
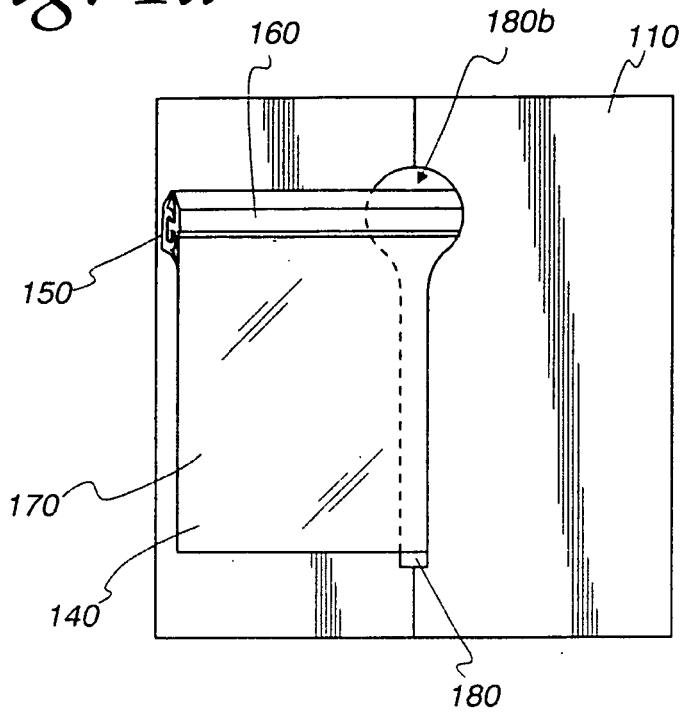
FIG. 1*a* is an enlarged view of section A of FIG. 1.
Figure 1B:
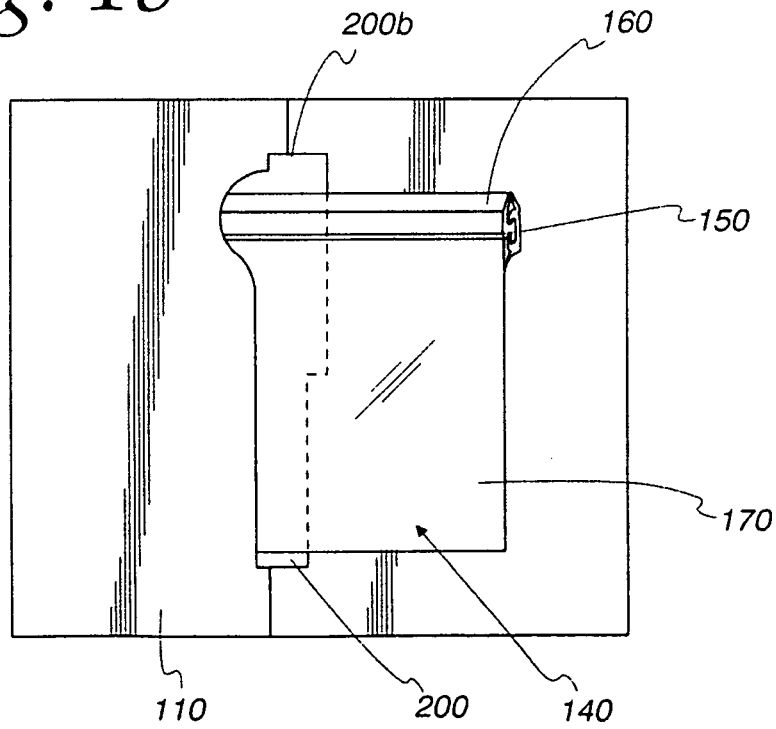
FIG. 1*b* is an enlarged view of section B of FIG. 1.

Turning now to FIGS. 1*a* and 1*b*, the detail of the first and second slots 180, 200, respectively, will be described. Each of the first and second slots 180, 200 is designed to form track receiving openings 180*b*, 200*b* that are larger than the rest of the first and second slots 180, 200. The track receiving openings 180*b*, 200*b* provide an opening for the male and female tracks 150, 160 which is thicker than the fins 170. The track receiving opening 200*b* in the second slot 200 is larger than the track receiving opening 180*b* in the first slot 180. In this embodiment, the track receiving opening 200*b* is an elongated slot, whereas the track receiving opening 180*b* is more circular in dimension, although other shapes may be used. The reason for the enlarged track receiving opening 200*b* will be described below.

FIG. 1 depicts both the punch 120 and the guide 130 in retracted positions. This is the position of the punch 120 and the guide 130 when the zipper 140 is first slid into position. During operation of the punch mechanism 100, the zipper 140 is advanced into the housing 110 and then stopped at a predetermined spot in the punch area 190 so that a guide notch may be cut.

Figure 2:
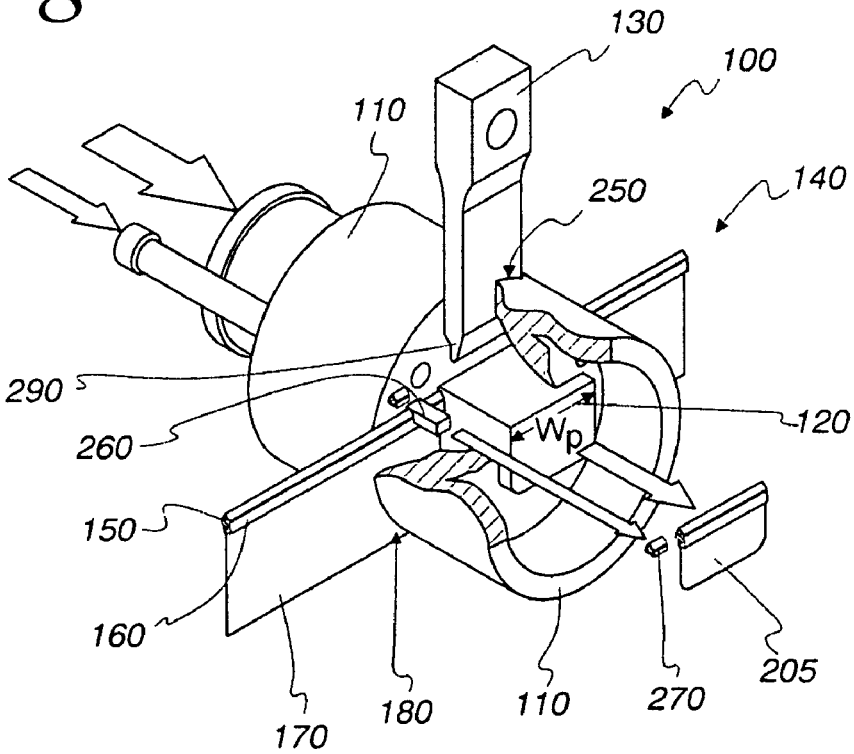
FIG. 2 is a partially cutaway perspective view of the punch mechanism of FIG. 1 with a punch in an extended position cutting a guide notch in a strip.
Figure 5:
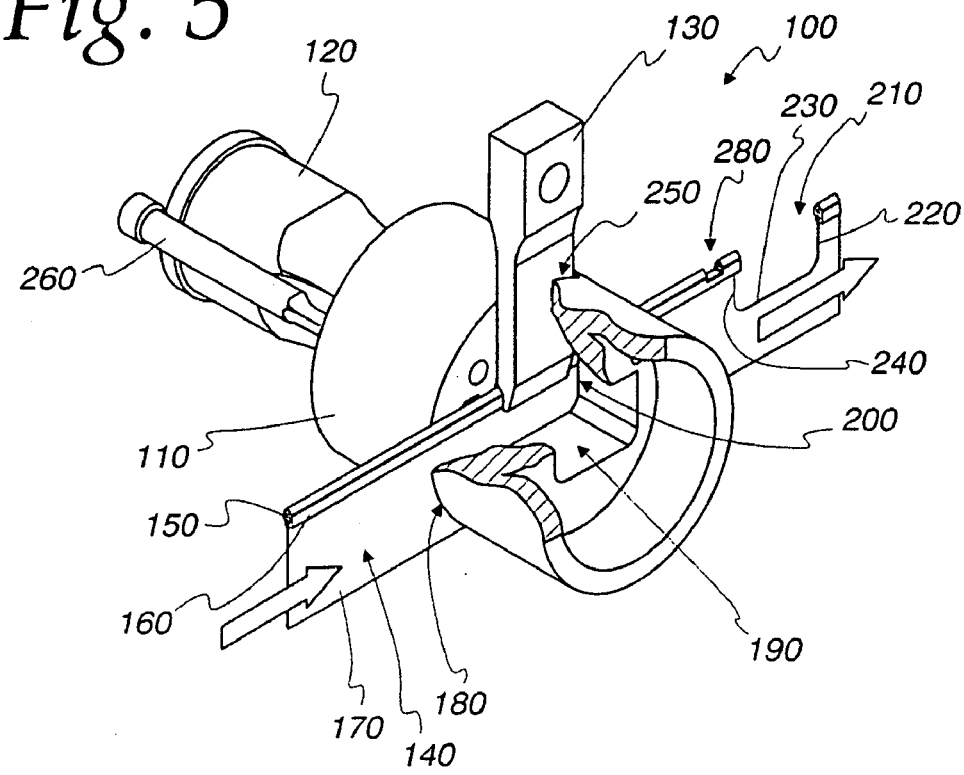
FIG. 5 is a partially cutaway perspective view of the punch mechanism of FIG. 1 depicting the guide notch advancing through the punch mechanism.

As shown in FIG. 2, once the zipper 140 is in place in the punch area 190, the punch 120 extends through the punch area 190, cutting out a piece 205 of the zipper 140 to create a guide notch 210 (shown best in FIG. 5). The punch 120 moves in a punching direction that is orthogonal to a slot plane defined by the first and second slots 180, 200, as indicated by the arrows in FIG. 2. The guide notch 210 may be any number of shapes and is defined by a plurality of edges. In the embodiment shown, the guide notch 210 is generally U-shaped and is defined by three edges 220, 230, 240 (shown in FIG. 5). The first edge 220 begins at the male and female tracks 150, 160 and extends downward into the fins 170. The second edge 230 begins at an end of the first edge 220 and extends along the fins 170 in a direction that is generally perpendicular to the first edge 220. The third edge 240 begins at an end of the second edge 230 that is opposite the first edge 220. Extending upwardly through the fins 170, the third edge 240 is generally parallel to the first edge 220 and extends up into the male and female tracks 150, 160.

The force of the punch 120 pressing into the zipper 140 cuts the piece 205. To cleanly cut the piece 205, i.e., to reduce tearing or stretching of the zipper 140, the punch 120 should have a tolerance of within 0.0004 inches of the housing 110. In other words, the punch 120 should only be able to move 0.0004 inches within the housing 110 in any direction, excluding the punching direction. If the punch 120 is able to move in directions other than the punching direction, the punch 120 may not create a clean cut in the zipper 140, which may ruin the zipper 140 or increase processing times.

Also shown in FIG. 2 is an embodiment in which the housing 110 includes a secondary punch 260. The secondary punch 260 extends down into the punch area 190 at the same time as the punch 120 and cuts a piece 270 out of the male and female tracks 150, 160 to create a secondary guide notch 280 (best shown in FIG. 5). This is done in the same way that the punch 120 creates the guide notch 210 described above. Generally, the secondary guide notch 280 is U-shaped, but it may be formed of a variety of shapes. The secondary guide notch 280 is utilized in the assembled zipper 140 to park a slider (not shown) that slides across the zipper 140 to open and close the zipper 140. When the zipper 140 is in a closed position, it is often desirable that the zipper 140 remain that way. The secondary guide notch 280 is used to park the slider in a position so that it does not inadvertently open the zipper 140. With the slider resting in the secondary guide notch 280, closure of the zipper 140 can be maintained. Some embodiments of the present invention may omit this feature.

Figure 3:
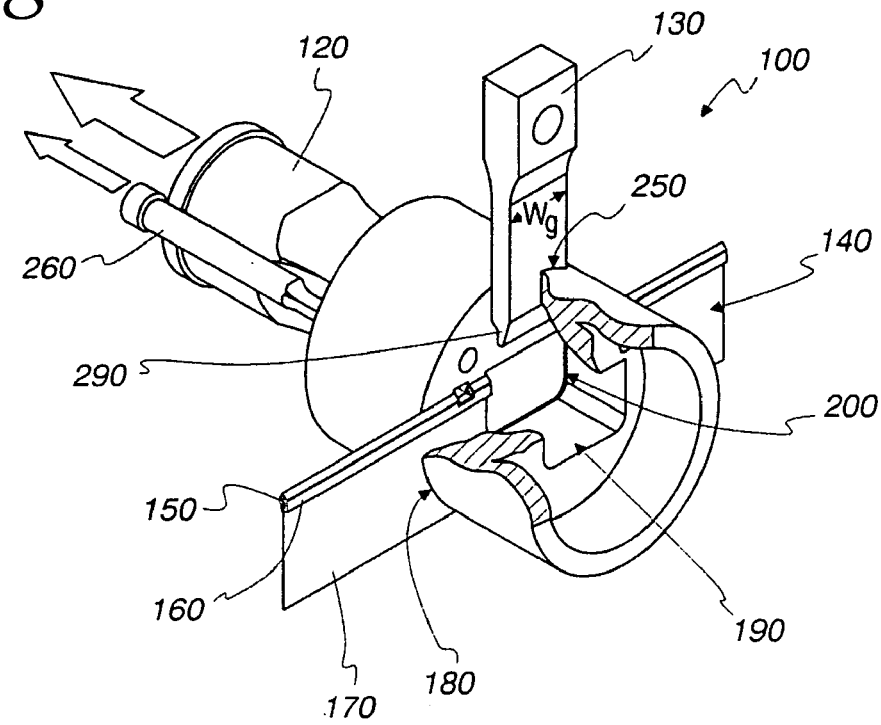
FIG. 3 is a partially cutaway perspective view of the punch mechanism of FIG. 1 with the punch retracted.
Figure 4:
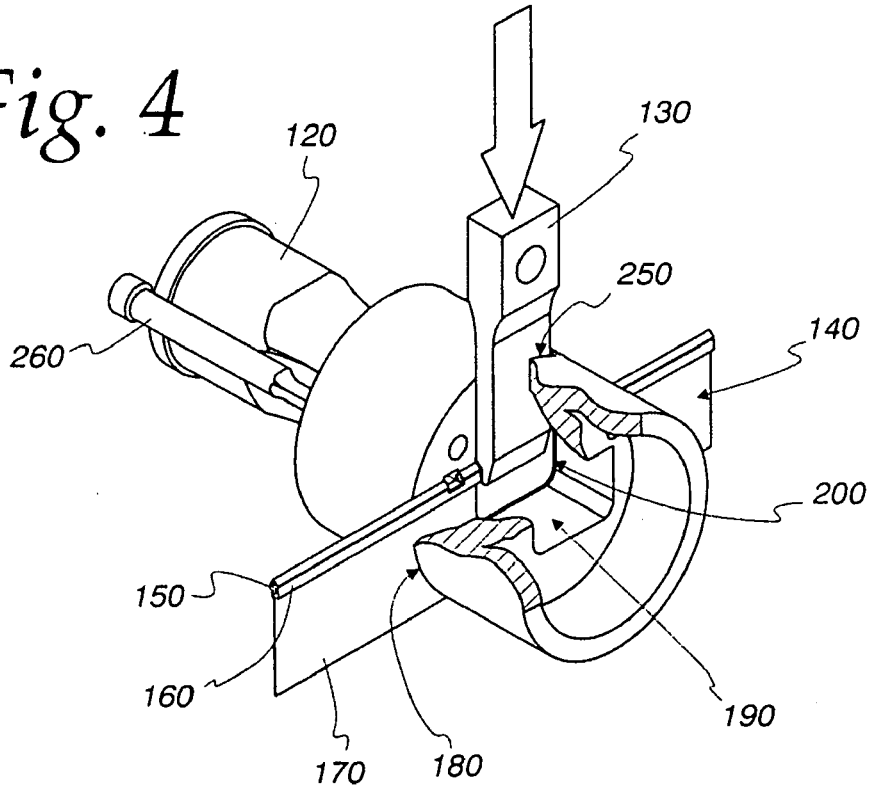
FIG. 4 is a partially cutaway perspective view of the punch mechanism of FIG. 1 depicting a guide in an extended position.

Turning now to FIG. 3, after the guide notch 210 (shown in FIG. 5) is cut into the zipper 140, the punch 120 is then retracted back to its original position. After the punch 120 is retracted back to its original position, the guide 130 is slid part of the way into the punch area 190 through a third slot 250, as shown in FIG. 4. The guide 130 enters the punch area 190 in a plane that is generally parallel to the plane defined by the first and second slots, 180, 200. In this embodiment, the guide 130 has a width $W_g$ approximately equal to a width $W_p$ of the punch 120. In one embodiment, the widths $W_g$ and $W_p$ are approximately 0.875 inches wide.

The guide 130 has a leading stepped edge 290. The stepped edge 290 of the guide 130 is designed to engage at least one of the male and female tracks 150, 160 of the zipper 140 at the third edge 240. In the embodiment shown, the stepped edge 290 engages the female track 160. When the guide notch 210 is advanced through the punch area 190 and towards the second slot 200, the stepped edge 290 of the guide 130 acts as a bridge to the third edge 240 and the rest of the male and female tracks 150, 160 (shown in FIG. 5). By utilizing the stepped edge 290 as a bridge, the third edge 240 is kept in line with the second slot 200. Thus, the third edge 240 slides easily through the second slot 200 without catching on the housing 110. This helps to ensure that the zipper 140 can easily move through the punch mechanism 100 without causing any tears in the zipper 140 or delays in the manufacturing process. Also, as mentioned above, the track receiving opening 200*b* of the second slot 200 is larger than the track receiving opening 180*b* of the first slot 180. This also aids in the easy movement of the third edge 240 through the second slot 200. The larger track receiving opening 200*b* gives the third edge 240 more room to slide through, decreasing the likelihood of the third edge 240 catching on the housing 110.

Figure 6:
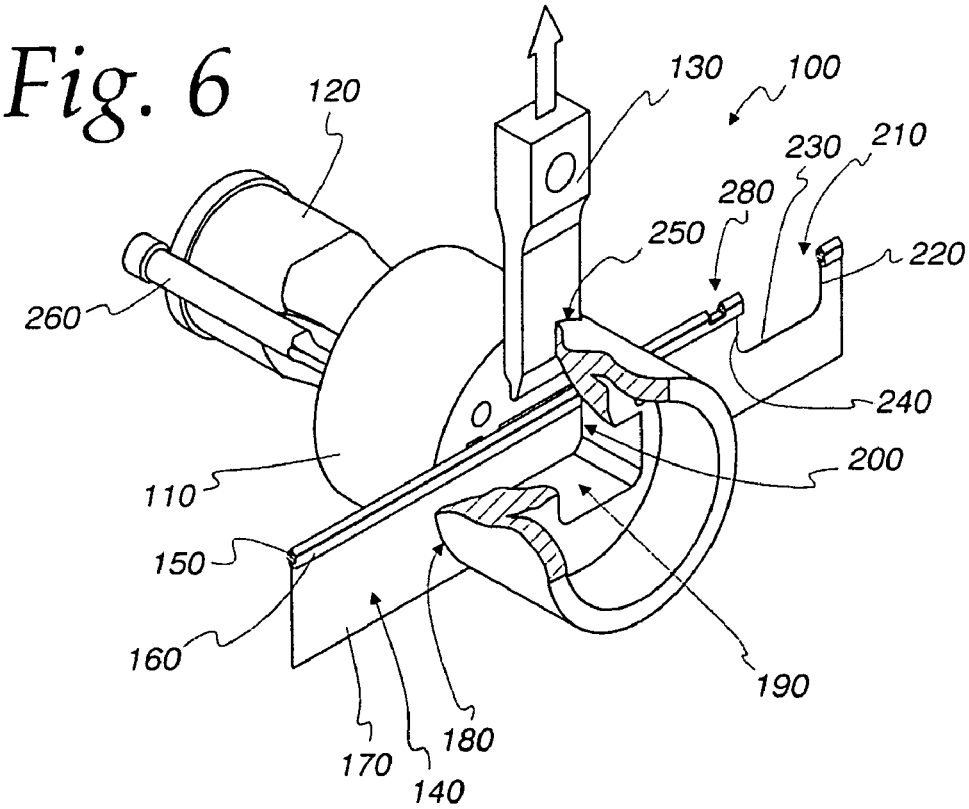
FIG. 6 is a partially cutaway perspective view of the punch mechanism of FIG. 1 depicting the guide in a retracted position.

After the guide notch 210 has completely moved through the second slot 200, the guide 130 retracts from the punch area 190 and returns to its original position, as shown in FIG. 6. The zipper 140 then advances to the next predetermined spot and the process begins again.

Figure 7:
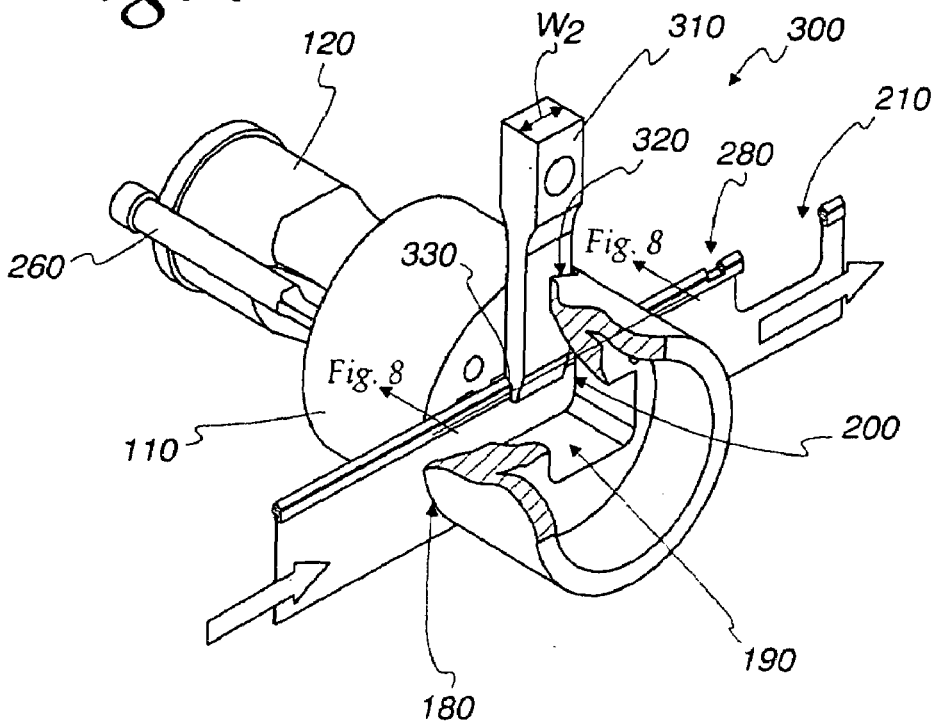
FIG. 7 is a partially cutaway perspective view of a punch mechanism according to another embodiment of the present invention.
Figure 8:
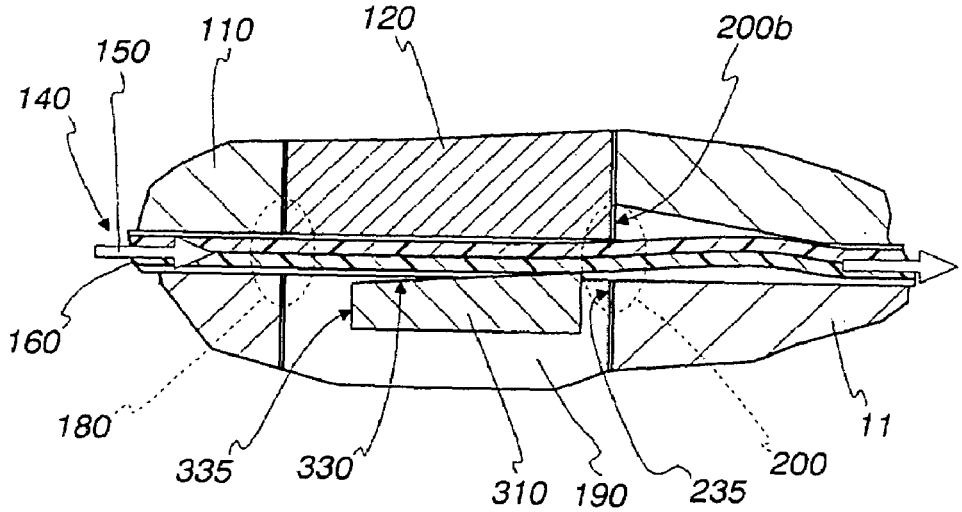
FIG. 8 is a cross-sectional view cut along the lines FIG. 8–FIG. 8 in FIG. 7.

Turning now to FIGS. 7 and 8, an alternative embodiment of the present invention will now be described. This embodiment operates in substantially the same way and like numerals will be used to describe like parts. In this embodiment, a punch mechanism 300 is shown that includes a guide 310 inserted into a third slot 320. The guide 310 and the third slot 320 have widths $W_2$ that are less than the width $W_p$ of the punch 120. Preferably, the widths $W_2$ of the guide 310 and slot 320 are approximately 15 to approximately 30% less than the width $W_p$ of the punch 120. In one embodiment, the width $W_2$ is approximately 0.625 inches. In some applications, it was discovered that utilizing a third slot that had a width equal to the width of the punch 120 caused problems. For example, when the punch 120 was extended into the punching area 190, the punch 120 moved into the third slot, which was greater than the 0.0004 inch tolerance stated above, resulting in not cutting cleanly into the zipper 140 and causing damage to zipper 140 or increased processing time.

In this embodiment, since the width $W_2$ of the guide 310 is less than the punch 120, the guide 310 does not extend across the whole width of the punch area 190. Thus, the male and female tracks 150, 160 at the third edge 240 may catch on either an end 335 of the guide 310 or on end 235 of the second slot 200, as occurred in previous punch mechanisms. To combat this problem, the guide 310 has a stepped surface 330. Instead of being straight like the stepped edge described above, however, the stepped surface 330 of this embodiment is slightly beveled or angled, as shown in FIG. 8. In this embodiment, as the guide notch 210 is advanced through the punch area 190 and out the second slot 200, the third edge 240 of the guide notch 210 hits the beveled stepped surface 330, which acts as a ramp. Thus, instead of catching on the end 335 of the beveled stepped surface 330, the third edge 240 contacts the beveled stepped surface 330 and slides up the ramp and away from end 235 out through the second slot 200 via the enlarged slot opening 200*b*. Thus, any tearing of the zipper 140 is avoided, as is any excess movement by the punch 120. Preferably, the beveled stepped surface 330 is angled from about 4 to about 10 degrees. The angle is towards the second slot 200 in order to best facilitate movement of the zipper 140.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A punching apparatus for punching a guide notch in a strip of a polymer zipper, said zipper having a female track and a male track, said punching apparatus comprising:

a housing having a first slot, a second slot, and an open region between said first and second slots, said first and second slots defining a slot plane extending therebetween, said slot plane having upper and lower slot plane boundaries corresponding to respective upper and lower edges of said first and second slots;

a punch slideably moveable within said open region, said punch entering said open region orthogonal to said slot plane defined by said first and second slots, at least a portion of said punch being aligned with one of said upper and lower slot plane boundaries; and a guide slideable into said open region, said guide entering said open region in a plane that is generally parallel to said slot plane.

2. The punching apparatus of claim 1, wherein said punch is adapted to cut through said zipper when said punch enters said open region, creating a guide notch.

3. The punching apparatus of claim 2, wherein said punch is adapted to create said guide notch such that said guide notch is formed by a plurality of edges.

4. The punching apparatus of claim 3, wherein said punch is adapted to create said plurality of edges such that said plurality of edges comprise a first edge, said first edge beginning at said male and female tracks and extending downward into fins below said male and female tracks, a second edge beginning at an end of said first edge and extending perpendicular to said first edge along said fins, and a third edge beginning at an end of said second edge opposite said first edge, and extending upward through said fins through said male and female tracks, said third edge generally parallel to said first edge.

5. The punching apparatus of claim 3, wherein said punch is adapted to create said guide notch such that said guide notch is U-shaped, bounded on three sides by said edges.

6. The punching apparatus of claim 2, wherein said guide notch in said zipper is bounded on two ends by said male and female tracks, and said guide is adapted to engage at least one of said male and female tracks to guide said zipper through said punching apparatus.

7. The punching apparatus of claim 6, wherein said guide has a stepped edge to engage at least one of said male and female tracks.

8. The punching apparatus of claim 6, wherein said guide has a beveled edge in the direction of movement of said zipper through said punching apparatus, said beveled edge acting as a ramp for at least one of said male and female tracks of said zipper.

9. The punching apparatus of claim 8, wherein said guide is beveled at an angle of approximately four to approximately six degrees.

10. The punching apparatus of claim 7, wherein said stepped edge is beveled in the direction of movement of said zipper, creating an angled step and acting as a ramp for at least one of the male and female tracks of said zipper.

11. The punching apparatus of claim 1, wherein said guide has a width approximately equal to the width of said punch.

12. The punching apparatus of claim 1, wherein said guide has a width approximately 15 to approximately 30% less than the width of said punch.

13. The punching apparatus of claim 1, wherein said punch is within approximately 0.0004 inches of said housing.

14. The punching apparatus of claim 1, wherein said first and second slots form track receiving openings to receive said male and female tracks, said track receiving openings being larger than the rest of said first and second slots, and said track receiving opening on said second slot is larger than said track receiving opening on said first slot.

15. The punching apparatus of claim 1, wherein said guide is adapted to engage at least one of said male and female tracks and to guide said male and female tracks through said second slot.

16. The punching apparatus of claim 1, wherein said housing further forms a guide slot, shaped to receive said guide and in communication with said open region, wherein said guide slot has a width that is approximately equal to a width of said punch.

17. The punching apparatus of claim 1, wherein said housing further forms a guide slot shaped to receive said guide and in communication with said open region, said guide slot having a width that is approximately 15 to approximately 30% less than the width of said punch.

18. The punching apparatus of claim 1, wherein said first and second slots form track receiving openings to receive a portion of said zipper that is larger than the rest of said first and second slots, and said track receiving opening on said second slot is larger than said track receiving opening on said first slot.

19. The punching apparatus of claim 1, wherein said guide has a stepped edge to engage a trailing edge of a guide notch to said second slot.

20. The punching apparatus of claim 19, wherein said stepped edge is beveled in a direction with respect to movement of said zipper, creating an angled step and acting as a ramp for at least one of said male and female tracks of said zipper.

21. The punching apparatus of claim 1, wherein said guide has a width approximately equal to a width of said punch.

* * * * *